US007356864B1

(12) United States Patent
Delfs

(10) Patent No.: US 7,356,864 B1
(45) Date of Patent: Apr. 15, 2008

(54) TUBULE FEATHERBED

(75) Inventor: Juliette M. Delfs, Seattle, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 11/618,476

(22) Filed: Dec. 29, 2006

(51) Int. Cl.
*A47C 27/00* (2006.01)
*A47G 9/00* (2006.01)

(52) U.S. Cl. ..... 5/691; 5/950; 5/500

(58) Field of Classification Search ..... 5/691, 5/950, 731, 737, 636, 645, 490, 500, 501, 5/502

See application file for complete search history.

(56) References Cited

U.S. PATENT DOCUMENTS

| | | | | |
|---|---|---|---|---|
| 2,021,237 | A | 11/1935 | Karr | |
| 3,459,179 | A | 8/1969 | Olesen | |
| 4,163,297 | A | 8/1979 | Neumark | |
| 4,274,169 | A | 6/1981 | Standiford | |
| 4,843,666 | A | 7/1989 | Elesh et al. | |
| 4,922,564 | A * | 5/1990 | Thomas | 5/727 |
| 4,924,541 | A | 5/1990 | Inagaki | |
| 5,117,519 | A * | 6/1992 | Thomas | 5/500 |
| 5,572,757 | A * | 11/1996 | O'Sullivan | 5/636 |
| 5,713,089 | A | 2/1998 | Ferrante | |
| 6,058,536 | A | 5/2000 | Henry | |
| 6,745,419 | B1 * | 6/2004 | Delfs et al. | 5/691 |
| 7,080,421 | B1 * | 7/2006 | Delfs | 5/645 |
| 2004/6745419 | | 6/2004 | Delfs et al. | |
| 2005/6961970 | | 9/2005 | Pedersen | |

* cited by examiner

*Primary Examiner*—Robert G. Santos
(74) *Attorney, Agent, or Firm*—Jensen & Puntigam, P.S

(57) ABSTRACT

The featherbed includes upper and lower fabric layers, with the upper layer being longer than the lower layer. Lines of stitching connect the upper layer to the lower layer at spaced lateral lines along the length of the featherbed, thereby defining successive abutting lateral half-tubules, which are filled such that the upper layer extends away from the lower layer in a curved configuration, defining a plurality of half-tubules, generally in the shape of half-ellipses, with the fill density being greater, approximately 21% than that of a similar-sized conventional featherbed.

26 Claims, 4 Drawing Sheets

TUBULE FEATHERBED

TECHNICAL FIELD

This invention relates generally to featherbeds, and more particularly concerns a featherbed construction comprising a plurality of separate adjacent chambers.

BACKGROUND OF THE INVENTION

Featherbeds in use are positioned on top of a conventional mattress. One concern of featherbed construction is to minimize significant shifting (migration) of fill material in the featherbed from one portion of the featherbed to another when the featherbed is in use. When migration is made difficult by a particular construction, however, restoration of the fill to its original location once some migration has occurred is very difficult. Another concern is to provide and maintain a good (high) loft for the featherbed, which provides not only an attractive appearance for the featherbed, but a comfortable, pleasing sensation in use.

Baffles are used in featherbed construction to create loft volumes (chambers) to hold highly compressible material such as feathers and down, and to limit migration of the filling. Baffle box construction is frequently used when baffle walls are higher than two inches. Lateral baffles increase the internal volume, permitting the use of more filling material, which increases initial loft and contouring compressibility. The taller the baffle, the greater the interior volume and the greater the fill weight required. However, the only commercially feasible way to fill the featherbed in manufacture is through openings in the baffles. These openings allow some migration of filling from one baffle chamber to the next in use, which results in the disadvantage of a generally permanent shifting of the filling material, since restoration of filling to its original location after migration is quite difficult with a typical partially open baffle structure.

Baffles have not been completely successful in preventing fill migration and make restoration difficult, if not impossible. Further, baffles produce a featherbed which appears relatively flat to the user, i.e. without significant loft, due to the evenness of the resulting surface of the featherbed, which can in turn give the impression that the featherbed will not provide the desired "sinking-in" sensation so attractive in a good featherbed.

An alternative to baffle construction is "sewn through" construction, in which the top fabric layer of the featherbed is attached directly to the bottom fabric layer, by sewing. An advantage of this construction is that it does control the migration of filling material. The disadvantages include a reduction in the overall loft of the featherbed and compression of the filling material over the entire sleep surface. In addition, the typical sewn-through construction limits the number of internal volumes, allowing contouring and compression because of too much shifting of the fill material within the individual chambers. This creates undesirable pressure points over the surface of the featherbed.

Hence, it is desirable to have a featherbed construction which provides a consistent high loft with an inviting appearance, as well as significant control over the migration of fill, reducing or eliminating uncomfortable pressure points.

SUMMARY

Accordingly, one aspect of the embodiment described herein is a featherbed, comprising: an upper featherbed fabric layer and a lower featherbed fabric layer, wherein the upper fabric layer is longer than the lower fabric layer; lines of stitching connecting the upper fabric layer to the lower fabric layer at spaced lateral lines along the length of the featherbed, the lines of stitching extending in a lateral dimension of the featherbed, wherein the ends of the upper layer are substantially coincident with the ends of the lower layer, and wherein the dimension of the upper layer is greater than the dimension of the lower layer between each line of stitching, thereby defining successive half-tubules with half-tubule volumes along the length of the featherbed; and filling provided in the half-tubule volumes, such that the upper layer extends away from the lower layer in an arcuate configuration for each half-tubule, with the lower layer being flat for each tubule.

BEST MODE FOR CARRYING OUT THE INVENTION

Figure 1:
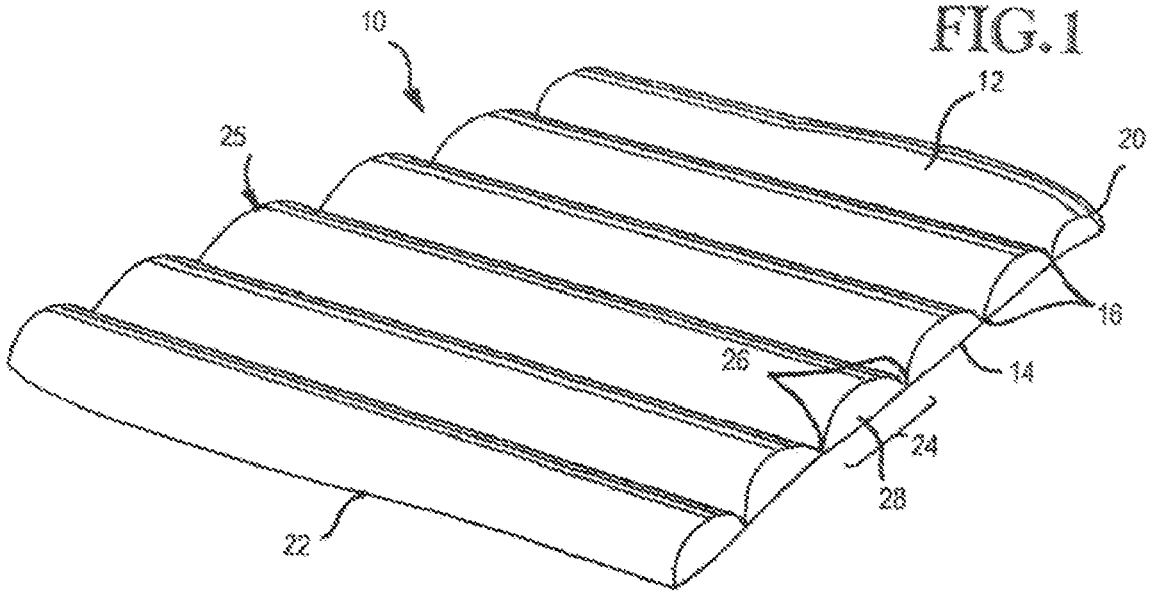
FIG. 1 shows a perspective view of the top surface of a first embodiment of the present invention.
Figure 2:
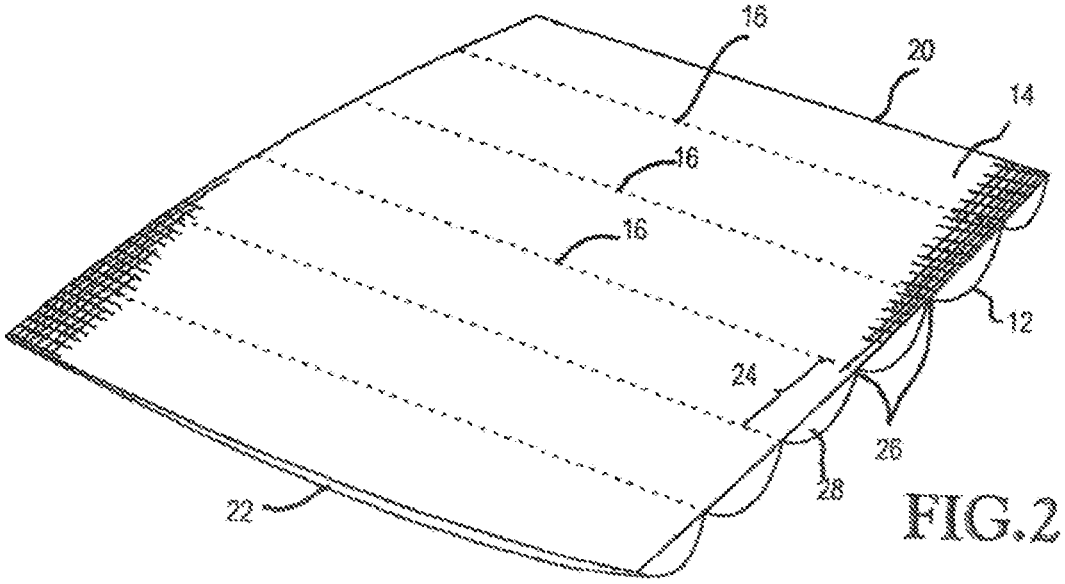
FIG. 2 is a perspective view of the back surface of the featherbed of FIG. 1.
Figure 3:
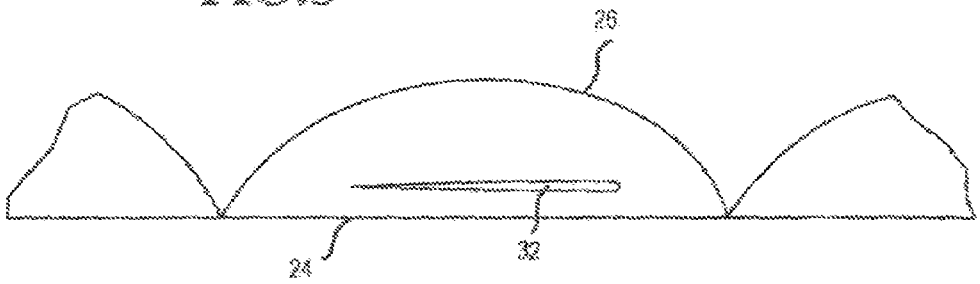
FIG. 3 is a side elevational view of a portion of the featherbed of FIG. 1.

FIGS. 1-3 show a first embodiment of a featherbed 10. Featherbed 10 includes an upper or top fabric panel 12 and a lower or back fabric panel 14. The top and back panels can be made of a variety of fabrics, but typically they will be made from woven material, such as cotton. As an alternative, the top panel could be quilted material. The top panel 12 in the embodiment shown is the same width as that of the bottom panel, but is substantially longer, in the range of 18-39% longer. For example, a queen-size featherbed will have a back panel approximately 60 inches wide by 80 inches long, with a top panel approximately 60 inches wide and 103½ inches long. The length of the top panel can vary to some extent, depending upon the desired configuration of the final product.

The top panel 12 is sewn to the back panel 14 along a plurality of lines of stitching 16 extending from side to side (across the width) of the featherbed. Upper ends 20 of the top and back panels, respectively, are coincident and sewn together, as are the lower ends 22 thereof. The extra length of the top panel is taken up between the successive lines of stitching 16, typically in the same amount for each successive segment of the panel. The resulting volume defined between each successive line of stitching is referred to generally as a tubule or in the specific embodiments herein, a half-tubule. It should be understood that the term "tubule" herein is broadly defined to be a volume having various cross-sections, such that half-tubules include approximately half circles or half ellipses, or other similar shapes, generally curved shapes.

In one embodiment, the back panel fabric portion 24 of each half-tubule 25 is approximately 10-14 inches wide, while the arcuate length of the top panel fabric portion 26 for each tubule is approximately 15-18 inches. The distance between the back panel portion 24 and the top panel portion 26 at the greatest height of the half-tubule is approximately 2-5 inches, although this can be varied. Preferably, the height of each half-tubule is 4 inches, which is the height of the baffles in the most luxurious featherbeds commercially available. This half-tubule configuration typically results in a uniform pressure along the user's resting body. The end pieces 28 of each tubule 25 can be separate fabric portions or the half-tubule ends of the top and back panels may be sewn directly closed, i.e. flat, without end pieces.

Each tubule (or half-tubule) will have an opening 32 at one end thereof which permits individual filling of the half-tubules, typically by a standard, well-known "blow-in" process. A six-inch opening 32 is one example for each half-tubule. The openings 32 are closed as a final step in the construction process.

The fill for the featherbed of FIGS. 1-3 can be various materials, including feathers, down, a blend of feathers and down, polyester material or combinations thereof.

The upper and lower fabric sections can be quilted or multi-layer fabrics, which provide a softer feel and protects against feather quills.

The fill density of the half-tubule featherbed is important. The fill must be sufficiently dense/compacted to control mounding, shifting and hollowing out of the fill but not so dense as to lose the "sinking-in" sensation. Feathers, down and some fiber material have these qualities; feathers in particular are advantageous in that, because of wider orientation, they easily come apart in re-loft following release of compression.

The half-tubule featherbed has approximately 21% less interior volume than a similar sized conventional featherbed in the present embodiment. A range is 15%-30%. Preferably, the same fill weight is used, however, so that the fill density is somewhat greater than that of a similar size conventional featherbed. In the embodiment shown, a range of density is 0.015-0.4 oz/in$^3$. Most preferably, the density is approximately 0.18 oz/in$^3$. This reduces shifting of fill material This reduction in interior volume occurs because of the half-tubule construction, with the resulting "voids" between adjacent half-tubules. Upon use of the half-tubule featherbed, and resulting compression, the voids are filled by the compressed crowns of the half-tubules until the entire structure stabilizes under the weight of the user.

The half-tubule construction with the specified fill density thus controls the limited compression and resulting temporary reconfiguration of the half-tubules, providing the desired sinking-in sensation. Upon release of the compression, the half-tubules rebound to their original shape, providing the desired high loft appearance. The half-tubule arrangements with a fill weight approximately that of a similar-sized conventional featherbed, and hence a greater fill density than such a featherbed, provides desired lofting, with appropriate compression for comfort and support, while preventing excessive shifting of material, without excessive fill, i.e. greater than that for conventional featherbeds of the same size.

Further, the half-tubule sizes may be varied along the length of the featherbed and filling weights may vary between the half-tubules, to provide specialized support or contouring for selected sleep areas. Each tubule could vary in size, both width and length, from the other tubules, to produce specific embodiments. Still further, the half-tubules may extend in the vertical (longitudinal) direction, instead of the lateral direction, and they may also include internal baffles along the length thereof to further compartmentalize the filling material.

The above tubule arrangement in general has several advantages. It provides right-sized filling chamber volumes which are in balance with fill density (fill weight per cubic area). With the specific half-tubule geometry, an ideal balance between free volume and compressibility is achieved without excessive interior volume. The shape of the half-tubules, with a perpendicular radius and with the longitudinal edges of successive tubules abutting each other, provide a significant loft for the featherbed and possess a desired "sinking-in" appearance and feeling. The void areas between adjacent half-tubules contribute to this sinking-in feeling. The half-tubule construction restricts the migration of fill from chamber to chamber without compacting the filling material, which is a typical result with conventional sewn-through constructions, although there is some migration of the fill within each tubule. This arrangement further distributes the pressure of the use over the entire surface area. Pressure points are minimized by the half-tubule configuration as well. An appearance of high loft is also achieved with the half-tubule arrangement.

A second embodiment of the invention is shown in FIGS. 4-7. That embodiment shows top and back panels 37,38 which are similar to the top and back panels of the embodiment of FIGS. 1-3, except that the longitudinal edges of the top panel include a plurality of adjacent scalloped portions 40-40 therealong, with the scalloped portions 40 being equal in number to the number of half-tubules along the featherbed. Each scalloped portion 40 has approximately the same base dimension 42 as the base dimension (width) of the half-tubules, while the arcuate dimension 44 has approximately the same dimension as the arcuate dimension of the tubule. The radius dimension 46 of the tubule is the same as the radius of the tubules.

Figure 4:
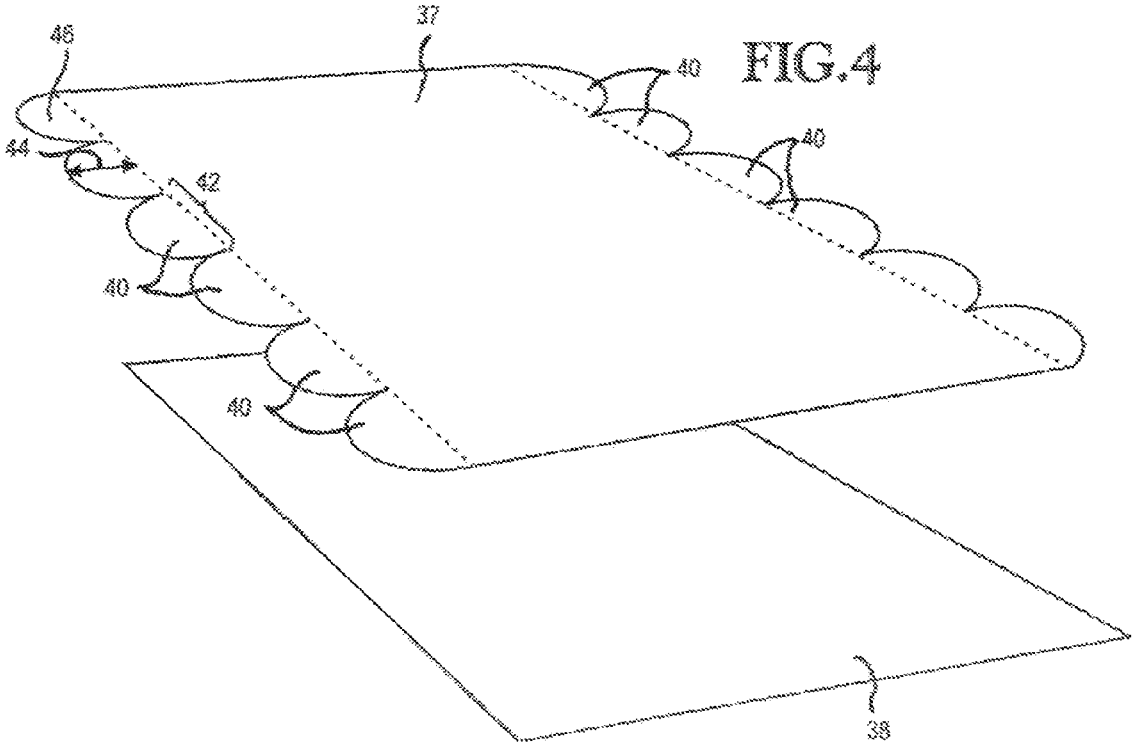
FIG. 4 is a perspective view of the top and back surfaces of a second embodiment of the present invention.
Figure 5:
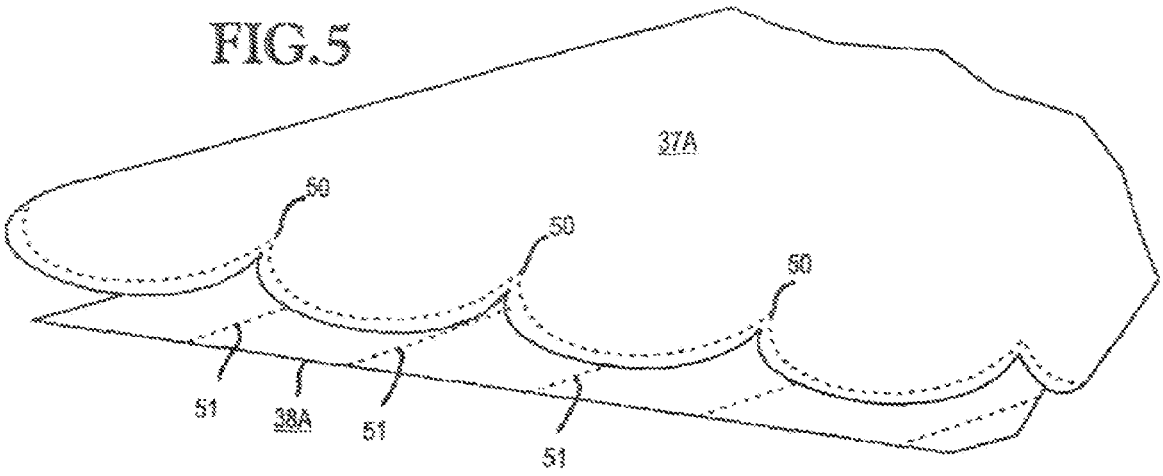
FIG. 5 shows one step in the manufacture of the featherbed of FIG. 4.
Figure 6:
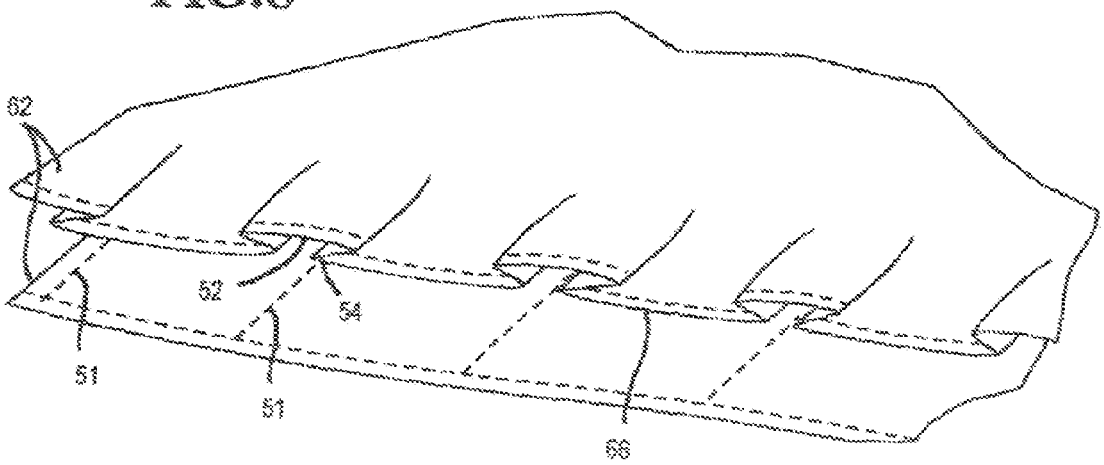
FIG. 6 shows another step in the manufacture of the featherbed of FIG. 4.
Figure 7:
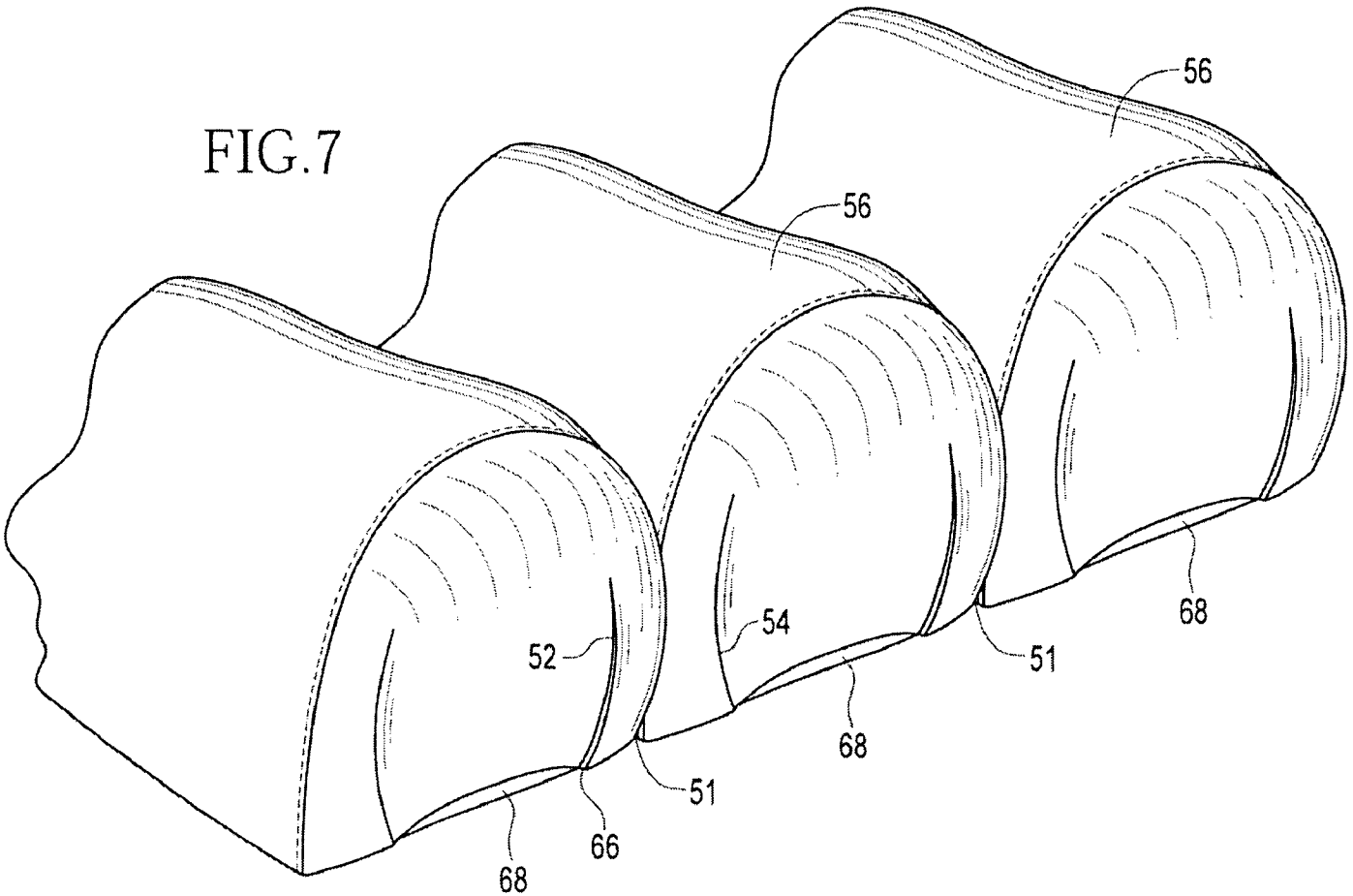
FIG. 7 is a perspective view of a portion of the finished featherbed of FIG. 4.

To manufacture the featherbed with the top and back panels of FIG. 4, the top panel and the back panel are arranged "wrong" sides 37A, 38A out ("right" sides, i.e. the exterior side of the final product, together), as shown in FIG. 5, with scallop points 50 being positioned on the desired tubule stitch lines 51. Each scalloped portion is then pleated at 52, 54 close to the desired stitch line, on each side of the stitch line. The pleats may be held in place by a few stitches. The top and back panels are then sewn together along one longitudinal edge and both end edges (edge 62 is exemplary).

The partially sewn combination of the top and back panels then is turned inside out so that the right sides 37B, 38B of each panel face out. The scalloped portions of the top panel still have the small pleats in them, close to the desired lines of tubule stitching 51. The top and back panels are then sewn together along the desired tubule stitch lines 51, forming the desired half-tubules 56 along the length of the featherbed. The edges of the scalloped portions along the other longitudinal edge 66 of the top panel are then partially sewn to the back panel, leaving an opening for blow-in of filling for each tubule.

Filling, similar to the first embodiment, is then blown into the tubules. The filling is sufficient in volume to "puff out" the scalloped end portions of each tubule, giving a puffy appearance to the opposing ends of each half-tubule. When filling is completed, the openings 68 between the scalloped portions and the back panel are sewn closed and the featherbed of FIGS. 4-7 is completed.

In both embodiments, the resulting featherbed comprises a plurality of abutting half-tubules, with the back panel of the featherbed being flat and the top panel being a succession of arcuate portions, thereby defining a plurality of successive volumes. Filling the successive volumes results in a featherbed which is comfortable over long use, with no migration of fill between chambers (the half-tubule volumes), while maintaining a consistent loft and providing a sinking-in sensation, without creating pressure points for the user.

Although a preferred embodiment of the invention has been disclosed for purposes of illustration, it should be understood that various changes, modifications and substitutions may be incorporated in the embodiment without departing from the spirit of the invention which is defined by the claims which follow.

What is claimed is:

1. A featherbed, comprising:

an upper featherbed fabric layer and a lower featherbed fabric layer, wherein the upper fabric layer is longer than the lower fabric layer;

lines of stitching connecting the upper fabric layer to the lower fabric layer at spaced lateral lines along the length of the featherbed, the lines of stitching extending in a lateral dimension of the featherbed, wherein the ends of the upper layer are substantially coincident with the ends of the lower layer, and wherein the dimension of the upper layer is greater than the dimension of the lower layer between each line of stitching, thereby defining successive half-tubules with half-tubule volumes along the length of the featherbed; and filling provided in the half-tubule volumes, such that the upper layer extends away from the lower layer in an arcuate configuration for each half-tubule, with the lower layer being flat for each half-tubule.

2. A featherbed of claim 1, wherein the half-tubule volumes are approximately half circles in cross section.

3. A featherbed of claim 1, wherein the half-tubule volumes are approximately half ellipses in cross section.

4. The featherbed of claim 1, wherein the height of the half-tubule volumes is within the range of two to five inches.

5. The featherbed of claim 1, wherein the height of the half-tubule volumes is approximately 4 inches.

6. The featherbed of claim 1, wherein the width of each half-tubule volume is within the range of 10-14 inches.

7. The featherbed of claim 1, wherein the length of the upper layer is approximately in the range of 18-39% longer than the length of the lower layer.

8. The featherbed of claim 1, wherein the filling comprises one of the following: (1) down, (2) feathers, (3) polyester, or (4) a combination of any of 1, 2 and 3.

9. The featherbed of claim 1, wherein the edges of the upper fabric layer of each half-tubule are sewn directly to the lower fabric layer of each half-tubule.

10. The featherbed of claim 1, including end fabric portions sewn to the longitudinal edges of the upper and lower fabric layers for each half-tubule, resulting in a puffy end appearance of each half-tubule when the featherbed is filled.

11. The featherbed of claim 1, wherein the filling varies by weight in a selected pattern between the half-tubule volumes.

12. The featherbed of claim 1, wherein the dimension of the lower layer between successive lines of stitching defines the width of the half-tubules, which varies along the length of the featherbed in accordance with a pre-selected pattern.

13. The featherbed of claim 1, wherein the dimension of the lower layer between successive lines of stitching defines the width of the half-tubules, which is substantially the same along the length of the featherbed.

14. The featherbed of claim 1, wherein the upper fabric layer includes a plurality of scalloped portions along each longitudinal edge, each scalloped portion being sewn to the lower fabric layer, forming the ends of each half-tubule, resulting in a puffy end appearance of each half-tubule when the featherbed is filled.

15. The featherbed of claim 14, wherein the scalloped portions are pleated.

16. The featherbed of claim 1, wherein the featherbed has a fill density which is approximately 21% greater than that for a similar sized, conventional featherbed.

17. The featherbed of claim 1, wherein the half-tubule volumes differ in height and/or width.

18. A featherbed, comprising:

an upper fabric layer and a lower fabric layer, wherein the upper layer is wider than the lower layer;

lines of stitching connecting the upper layer to the lower layer along longitudinal lines spaced across the width of the featherbed, the lines of stitching extending in a longitudinal dimension of the featherbed, wherein the longitudinal edges of the upper layer are substantially coincident with the corresponding longitudinal edges of the lower layer, and wherein the dimension of the upper layer is greater than the dimension of the lower layer between each line of stitching, thereby defining successive abutting longitudinal half-tubules, with half-tubule volumes, across the width of the featherbed; and filling in the half-tubule volumes, such that the upper layer extends away from the lower layer in an arcuate configuration for each half-tubule, with the lower layer being substantially flat.

19. A featherbed of claim 18, wherein the half-tubule volumes are approximately a half circle in cross section.

20. A featherbed of claim 18, wherein the half-tubule volumes are approximately a half ellipse in cross section.

21. The featherbed of claim 19, wherein the height of the half-tubule volumes is within the range of 2-5 inches.

22. The featherbed of claim 21, wherein the height of the half-tubule volume is approximately 4 inches.

23. The featherbed of claim 18, wherein the width of each half-tubule is within the range of 10-14 inches.

24. The featherbed of claim 18, wherein the filling comprises one of the following: (1) down, (2) feathers, (3) polyester, or (4) a combination of any of 1, 2 and 3.

25. The featherbed of claim 18, wherein the featherbed has a fill density which is approximately 21% greater than that for a similar sized conventional featherbed.

26. The featherbed of claim 18, wherein the half-tubule volumes differ in height and/or width.

* * * * *